US008162292B2

(12) United States Patent
Farmer

(10) Patent No.: US 8,162,292 B2
(45) Date of Patent: Apr. 24, 2012

(54) ANIMAL BARRIER DEVICE

(76) Inventor: Andrew Farmer, Horsham (GB)

( * ) Notice: Subject to any disclaimer, the term of this patent is extended or adjusted under 35 U.S.C. 154(b) by 0 days.

(21) Appl. No.: 11/587,980

(22) PCT Filed: Apr. 28, 2005

(86) PCT No.: PCT/GB2005/001633

§ 371 (c)(1),
(2), (4) Date: Jun. 13, 2008

(87) PCT Pub. No.: WO2005/104827

PCT Pub. Date: Nov. 10, 2005

(65) Prior Publication Data

US 2008/0265230 A1 Oct. 30, 2008

(30) Foreign Application Priority Data

Apr. 29, 2004 (GB) ..... 0409574.1

(51) Int. Cl.
*E04H 17/00* (2006.01)

(52) U.S. Cl. ..... 256/12; 256/11; 160/242

(58) Field of Classification Search ..... 256/11, 256/12; 119/52.2–52.4, 57.8, 57.9, 516, 119/523, 524, 652, 663, 667, 669, 672, 702, 119/705, 706, 707, 711; 52/101; 43/69, 43/71, 72, 74; 193/35 R, 37; 160/120, 242
See application file for complete search history.

(56) References Cited

U.S. PATENT DOCUMENTS

| | | | | |
|---|---|---|---|---|
| 3,252,556 | A * | 5/1966 | Sven-Eric Isacsson | 193/37 |
| 3,599,769 | A * | 8/1971 | Gardella | 193/35 R |
| 3,757,370 | A * | 9/1973 | Seno et al. | 441/133 |
| 4,050,561 | A * | 9/1977 | Seitz | 193/35 R |
| 4,148,386 | A * | 4/1979 | Bradbury | 193/37 |
| 4,311,226 | A * | 1/1982 | Thompson et al. | 193/35 R |
| 4,326,619 | A * | 4/1982 | Garnett | 193/37 |
| 4,645,071 | A * | 2/1987 | Faulkner et al. | 198/842 |
| 4,681,203 | A * | 7/1987 | Kornylak | 193/35 R |
| 4,969,548 | A * | 11/1990 | Kornylak | 193/35 R |
| 5,143,354 | A | 9/1992 | Nolan | |
| 5,323,512 | A * | 6/1994 | Little | 16/332 |
| 5,497,585 | A * | 3/1996 | Engler | 52/101 |
| 5,517,784 | A * | 5/1996 | Sedore | 43/69 |
| 5,528,852 | A * | 6/1996 | Sarff | 43/71 |
| 5,918,404 | A * | 7/1999 | Ohba | 43/1 |
| 5,996,274 | A * | 12/1999 | Smith et al. | 43/71 |
| 6,261,207 | B1 * | 7/2001 | Publicover et al. | 482/27 |
| 6,367,419 | B1 * | 4/2002 | Gosselin | 119/57.8 |
| 6,585,233 | B1 * | 7/2003 | Sorben | 256/12 |

FOREIGN PATENT DOCUMENTS

DE 2206436 8/1973

* cited by examiner

*Primary Examiner* — Michael P Ferguson
*Assistant Examiner* — Nahid Amiri
(74) *Attorney, Agent, or Firm* — Levy & Grandinetti

(57) ABSTRACT

An animal barrier device comprising one or more rotating bodies and fixture structures, in which in use the fixture structures, rotatably support the one or more rotating bodies on a construction with which the animal barrier is used, in which each rotating body is an elongate body which rotates in use about a longitudinal axis, and in which the longitudinal axis is located at any point on a line between a center of the rotating body and a point below the rotating body.

11 Claims, 1 Drawing Sheet

ANIMAL BARRIER DEVICE

CROSS-REFERENCE TO RELATED APPLICATIONS

This application is the U.S. National Phase of PCT Application Number PCT/GB2005/001633, filed on Apr. 28, 2005, which claims priority to Great Britain Application Number BG-A-04 09574.1, filed Apr. 29, 2004.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION BY REFERENCE OF MATERIAL SUBMITTED ON A COMPACT DISC

Not Applicable.

BACKGROUND OF THE INVENTION (1) Field of the Invention

This invention relates to an animal barrier device, for use particularly, but not exclusively, with pet cats.

(2) Description of Related Art Including Information Disclosed Under 37 CFR 1.97 and 1.98

It is often desired to prevent a pet, in particular a cat, from leaving the confines of a private garden or compound for safety reasons. However, domestic house cats can scale traditional walls of fences with ease.

Many properties are provided with medium or large sized gardens, which may require a considerable length of fencing to enclose them. It would therefore be expensive to construct an entire fence which could not be scaled by an animal.

BRIEF SUMMARY OF THE INVENTION

The present invention is intended to overcome some of the above problems.

Therefore, according to the present invention an animal barrier device comprises one or more rotating bodies and fixture means, in which in use the fixture means rotatably supports the one or more rotating bodies on a construction with which the animal barrier is used, in which each rotating body is an elongate body which rotates in use about a longitudinal axis, and in which the longitudinal axis is located at any point on a line between a centre of the rotating body and a point below the rotating body.

The object of the animal barrier is to provide a rotating body on a construction, which rotates when an animal attempts to scale the construction and touches the rotating body. With this arrangement any attempt to breach the animal barrier will result in the animal falling back down again.

It will be appreciated that the animal barrier could be located on any construction, for example a window frame or other ledge. However in a preferred embodiment the animal barrier can be disposed in use on the top of a wall or fence.

It will also be appreciated that a single rotating body could be used if the wall or fence were short in length. However, in a preferred construction the animal barrier comprises a number of rotating bodies, and said rotating bodies can be arranged in a row along the top of the fence or wall.

In one construction the fixture means can comprise one or more springs and each rotating body can be mounted on at least one spring, such that each rotating body can rotate about a longitudinal axis which is located on said line at a point below the rotating body.

However, in a preferred construction each elongate body can rotate about a longitudinal axis extending along its centre, and the fixture means can comprise axle means which rotatably support each rotating body, and base means which support the axle means. The rotating bodies can be cylindrical. A clearance between the top of the wall or fence and the one or more rotating bodies can be too small for a cat to breach.

In a preferred construction the base means can movably support the axle means such that the axle means can move in use along a line normal to their length. With this arrangement each rotating body can rotate on its own longitudinal axis, and it can move back and forth.

In one construction each rotating body can by wider that the width of the fence or wall, and in a preferred arrangement the base means can movably support the axle means such that each rotating body can move between a first position where a first side is level with a first side of the wall or fence, and a second position where a second side is level with a second side of the wall or fence.

With this arrangement each rotating body can only move back and forth to such an extent that no ledge is provided before or behind it, upon which an animal may be able to gain a purchase.

Preferably the base means comprises at least two base units, one at each end of each rotating body, and the axle means can comprise a spigot extending from each base unit, which can co-operate with a socket at each end of each rotating body. In another embedment the axle means can further comprise bearing means to improve the rotational support and movement of the rotating elements. In one construction the rotating bodies can be provided with a continuous aperture through their centre, such that the socket at each end comprises the part of the aperture adjacent each end.

In one embodiment the base units can be attached in use to the top of a wall or fence in a spaced apart manner, with rotating bodies disposed there between. With this arrangement there can be spaces between each rotating body. Therefore, the animal barrier can further comprise round or elliptical elements which are disposed between each rotating element. The round or elliptical elements can be shaped or dimensioned such that an animal could not perch thereon.

The base units can be attached in use to fence posts which are spaced apart along the length of a fence. In a preferred construction the base units may comprise a fence post cap, provided with screw holes to fix it to the top of a fence post, at least one axle means on one side, and a round or elliptical element on the top.

Preferably the rotating bodies can be provided from long strips of cylindrical material, which are cut to fit the spaces between the fence posts of a fence.

Therefore, the invention also includes: a kit of parts for an animal barrier device, in which the kit of parts comprises one or more elongate bodies and fixture means, in which in use the fixture means are fixed to a construction with which the animal barrier device is used, in which in use the one or more elongate bodies are cut into one or more rotating bodies of a required length to suit the construction, in which in use the fixture means rotatably support the one or more rotating bodies on the construction, in which each rotating body rotates in use about a longitudinal axis, and in which the longitudinal axis is located at any point on a line between a centre of the rotating body and a point below the rotating body.

It will be appreciated that an animal barrier device as described above could be integral with a fence or wall, and not supplied as a secondary or aftermarket product.

Therefore, the invention also includes an animal barrier device comprises a construction, one or more rotating bodies and fixture means, in which the fixture means rotatably supports the one or more rotating bodies on the construction, in which each rotating body is an elongate body which rotates in use about a longitudinal axis, and in which the longitudinal axis is located at any point on a line between a centre of the rotating body and a point below the rotating body.

The invention can be performed in various ways, but one embodiment will now be described by way of example and with reference to the accompanying drawings in which:

DETAILED DESCRIPTION OF THE INVENTION

Figure 1:
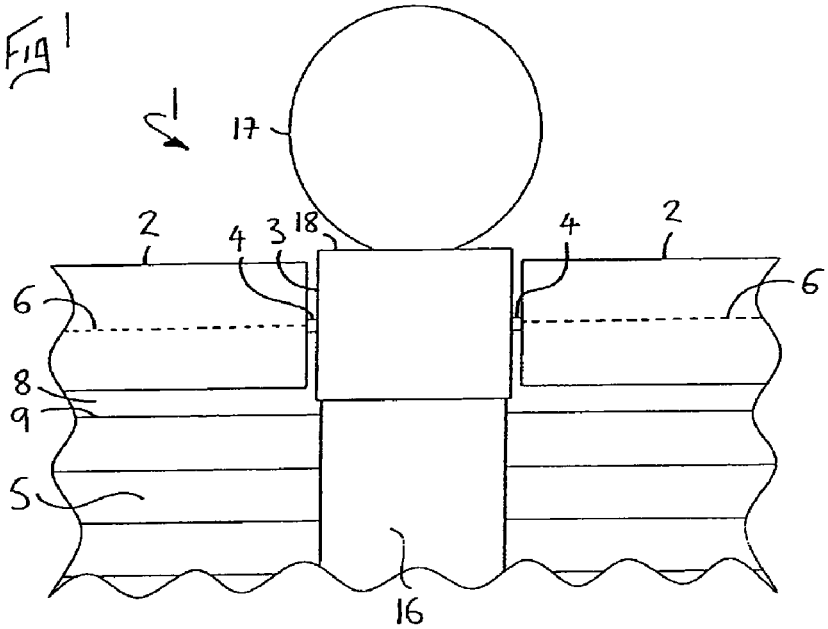
FIG. 1 is a front view of a section of an animal barrier according to the present invention; and, FIGS. 2*a* to 2*c* are cross-sectional side views of the animal barrier as shown in FIG. 1.

As shown in FIG. 1 animal barrier device 1 comprises a number of rotating bodies 2 and fixture means, in the form of fence post cap 3 and axles 4. In use the fixture means (3 and 4) rotatably supports the rotating bodies 2 on a construction, in the form of fence 5, with which the animal barrier 1 is used. Each rotating body 2 is an elongate body which rotates in use about a longitudinal axis 6.

Figure 2A:
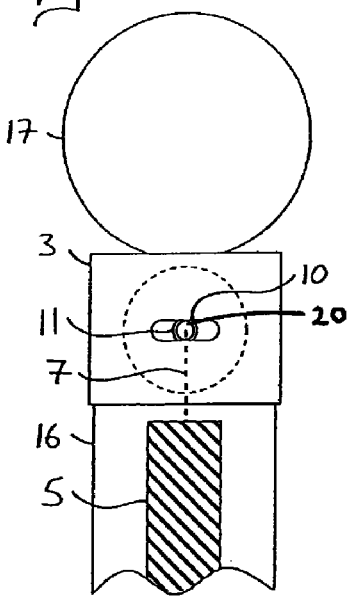

In the Statement of Invention the longitudinal axis is located at any point on a line between a centre of the rotating body and a point below the rotating body. In the Figures the longitudinal axis 6 is located at the top of such a line, which is shown in FIG. 2*a* at reference numeral 7. It will be appreciated that if the fixture means were one or more springs 22 mounted on the top of the fence post and supporting the rotating bodies 2, the longitudinal axis 6 could be at the bottom of the line 7.

FIG. 1 shows a section of animal barrier 1, and it will be appreciated that fence post caps like the one 3 shown in FIG. 1 could be located at any number of fence posts along the length of a fence, and any number of rotating bodies 2 could be located there between. In addition, it would also be possible to have just one rotating body 2, and one fence post cap 3 at each end. Also, the fence post cap 3 shown in the Figures has axles 4 arranged on two opposite sides, but it will be appreciated that a fence post cap could be provided with axles 4 on two adjacent sides, which could be used at the corner of a fence.

As is shown in the Figures, the longitudinal axis 6 extends along the centre of the rotating bodies 2, which are cylindrical. The axles 4 rotatably support the rotating bodies 4, by being disposed in apertures (not visible) which are provided through the rotating bodies 2, and coincide with the axis 6. The rotating bodies 2 are disposed such that a clearance 8 between the top 9 of the fence 5 and the rotating bodies 2 is too small for a cat to breach.

Figure 2B:
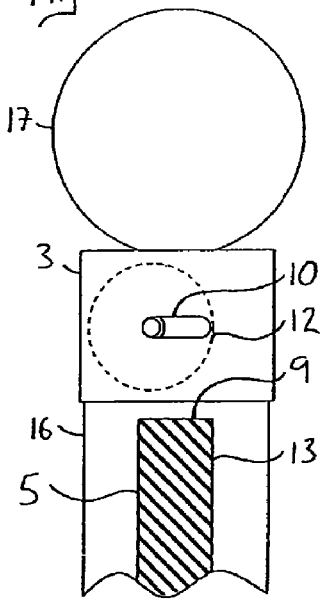
Figure 2C:
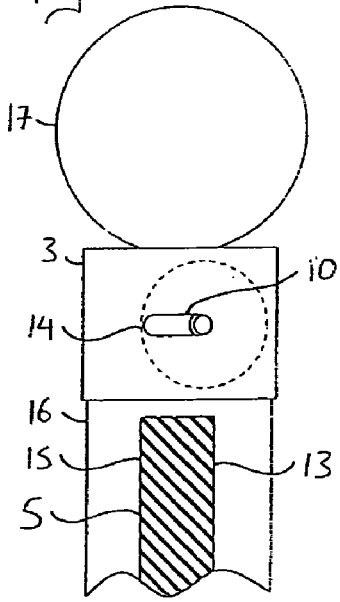

The axles 4 are movably supported by the caps 3. The axles 4 are disposed in a socket 10 (as shown in FIGS. 2*a* to 2*c*) and can move back and forth along the socket 10. It will be appreciated that there are many known ways this motion can be achieved, but in animal barrier 1 the axles are provided with a circular base 11, which is disposed behind socket 10 to support the axles 4.

As is clear from FIGS. 2 *a* to 2*c*, the rotating bodies 2 are wider that the width of the fence 5. In addition, the socket 10 is dimensioned such that each rotating body 2 can move between a first position, as shown in FIG. 2*b*, where a first side 12 is level with a first side 13 of the fence 5, and a second position, as shown in FIG. 2*c*, where a second side 14 is level with a second side 15 of the fence 5.

As is clear from FIG. 1, the fence post cap 3 is attached in use to a fence post 16, and as a result there is a space between the rotating bodies 2. Therefore, ball 17 is provided on the top 18 of the fence post cap 3, and similar balls can be provided on the top of other fence post caps disposed along the length of the fence 5.

The fence post cap 3 is screwed onto the top of the fence post 16 by means of screws (not visible).

In use, when an animal, for example a cat, attempts to scale the fence 5 it will contact a rotating body 2. As a result the rotating body 2 will rotate about the axis 6, and the cat will gain no purchase and slip off. In addition, the rotating body 2 may move back or forth as a result of the axles 4 being formed by sockets 10 and spigots 20, which makes passing the animal barrier 1 even harder. In particular, if the cat attempts to scale the fence 5 from the first side 13, when the rotating body 2 is in the position shown in FIG. 2*c*, the rotating body 2 will rotate on axis 6, and may move away from the cat, causing it to very readily fall back.

If a cat attempts to scale the first side 13 of the fence 5 when the rotating body 2 is in the position shown in FIG. 2*b*, the above described linear movement may not occur, but because the first side 12 of the rotating body 2 is level with the first side 13 of the fence 5, there is still no manner in which an animal could gain access to the top 9 of the fence 5.

If an animal tries to pass over the fence 5 at the location of the fence post 16, it will not be able to pass over the ball 17.

The invention also includes a kit of parts for an animal barrier device, in which the kit of parts comprises one or more elongate bodies and fixture means.

In the embodiment described above, the kit of parts includes lengths of annular material with an aperture running down their centre. The lengths of material are cut into lengths which correspond approximately to the distance between fence posts 16 on the fence 5, and thereby the rotating bodies 2 are formed.

The embodiment could be altered without departing from the spirit of the invention. For example, in an alternative embodiment (not shown) the axles 4 and/or the rotating bodies 2 could be provided with a bearing between them to improve the rotation movement of the rotating bodies 2.

In another alternative embodiment (not shown) the balls 17 could be replaced with tear-drop shaped elements comprising a generally ball-shaped portion, at a tapered top section. Such a shape can be even harder for an animal to scale.

In another embodiment (not shown) the fixture means comprises one or more springs mounted on the top of the fence, and the rotating bodies are carried on the springs. With this arrangement the rotating bodies may rotate about a point at the bottom of line 7.

The invention further includes an arrangement in which the an animal barrier device as described above is integral with a construction. Therefore, in one other alternative embodiment (not shown) the animal barrier device 1 is integrally formed with the fence 5. In such an embodiment the axles 4 are provided as part of the fence post 16, and no fence post cap 3 is required.

Thus, an animal barrier is provided which can be readily fitted to an existing fence or wall, and which also provides an effective barrier for animals, in particular cats.

The invention claimed is:

1. An animal barrier device comprising a wall or fence, one or more elongate rotating bodies and fixture means adapted to mount the one or more elongate rotating bodies on said wall or fence, in which said wall or fence comprises a first side, and stands with said first side arranged vertically, in which said wall or fence comprises a top surface perpendicular to said first side, in which said one or more elongate rotating bodies are mounted on said wall or fence above and in parallel with said top surface such that they lie in the direct path of an animal attempting to pass over the wall or fence, in which the fixture means comprises bases with elongate sockets and axles which rotatably support each rotating body such that they are rotatable about a longitudinal axis extending along their centre, in which said axles are disposed without biasing in said elongate sockets, and in which said sockets are arranged perpendicular with said first side and parallel in longitudinal direction with a width-wise extent of said top surface such that the axles move in use back and forth above said wall or fence along a line substantially normal to said longitudinal axis and perpendicular with said first side and parallel with a width-wise extent of said top surface.

2. An animal barrier device as claimed in claim 1 in which the animal barrier device comprises a number of rotating bodies, which are arranged in use in a row along a top of the wall or fence.

3. An animal barrier device as claimed in claim 2 in which each rotating body is wider than the width of the fence or wall.

4. An animal barrier device as claimed in claim 3 in which the axles are disposed in said elongate sockets such that each rotating body is movable between a first position where a first side of the rotating body is co-planar with a first side of the wall or fence, and a second position where a second side of the rotating body is co-planar with a second side of the wall or fence.

5. An animal barrier device as claimed in claim 2 in which the rotating bodies are cylindrical.

6. An animal barrier device as claimed in claim 5 in which each axle comprises a spigot extending from a base which cooperates with a socket at each end of each rotating body.

7. An animal barrier device as claimed in claim 6 in which the rotating bodies are provided with a continuous aperture through their centre, such that the socket at each end of each rotating body comprises the part of the aperture adjacent each end of the rotating body.

8. An animal barrier device as claimed in claim 7 in which the bases are attached to the top of the wall or fence in a spaced apart manner, and the rotating bodies are disposed between the bases.

9. An animal barrier device comprising:

a wall or fence, one or more elongate rotating bodies, and bases with elongate sockets and axles adapted to mount the one or more elongate rotating bodies on said wall or fence, in which said wall or fence comprises a top surface perpendicular to a first side, in which said one or more elongate rotating bodies are mounted on said wall or fence above and in parallel with said top surface such that they lie in the direct path of an animal attempting to pass over the wall or fence, in which the axles rotatably support each rotating body such that they are rotatable about a longitudinal axis extending along their centre, and in which said axles are disposed without biasing in said elongate sockets, and in which said sockets are arranged perpendicular with said first side and parallel in longitudinal direction with a width-wise extent of said top surface such that the axles are movable back and forth above said wall or fence along a line substantially normal to said longitudinal axis and perpendicular with said first side and parallel with a width-wise extent of said top surface;

the animal barrier device comprises one or more elongate rotating bodies, which are arranged in use in a row along a top of the wall or fence;

each axle comprises a spigot which cooperates with an elongate socket at each end of each rotating body;

the rotating bodies are provided with a continuous aperture through their centre, such that the elongate sockets at each end of each rotating body comprise the part of the aperture adjacent each end of the rotating body;

the elongate sockets are at the top of the wall or fence in a spaced apart manner, the rotating bodies are disposed between the elongate sockets; and a top of each base is provided with a ball.

10. An animal barrier device as claimed in claim 9 in which the bases are attached in use to fence posts which fence posts form a part of the wall or fence and are spaced apart along the length of the wall or a fence.

11. An animal barrier device as claimed in claim 10 in which each base comprises a fence post cap, provided with axle on at least one side thereof, and said ball on a top thereof.

* * * * *